US006126782A

United States Patent [19]

Liden et al.

[11] Patent Number: 6,126,782

[45] **Date of Patent: *Oct. 3, 2000**

[54] METHOD FOR NON-CHLORINE BLEACHING OF CELLULOSE PULP WITH A TOTALLY CLOSED COUNTER-CURRENT LIQUID CIRCUIT

[75] Inventors: Jan G. Liden, Domsjö; Lars Å. G. Ahlenius, Örnsköldsvik; Otto S. A. G. Lindeberg, Domsjö; Sture E. O. Noréus, Husum, all of Sweden

[73] Assignee: Mo Och Domsjo Aktiebolag, Ornskoldsvik, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/663,047

[22] PCT Filed: Dec. 14, 1994

[86] PCT No.: PCT/SE94/01204

§ 371 Date: Jul. 8, 1996

§ 102(e) Date: Jul. 8, 1996

[87] PCT Pub. No.: WO95/16818

PCT Pub. Date: Jun. 22, 1995

[30] Foreign Application Priority Data

Dec. 15, 1993 [SE] Sweden ..... 9304173

[51] Int. Cl.[7] ..... D21C 9/14; D21C 9/147; D21C 9/153; D21C 9/16

[52] U.S. Cl. ..... 162/30.1; 162/65; 162/76; 162/78; 162/88

[58] Field of Search ..... 162/65, 37, 76, 162/40, 78, 41, 88, 42, 89, 43, 29, 30.1, 30.11

[56] References Cited

U.S. PATENT DOCUMENTS

| | | | |
|---|---|---|---|
| 5,143,580 | 9/1992 | Basta et al. | 162/65 |
| 5,401,362 | 3/1995 | Lindberg | 162/65 |
| 5,509,999 | 4/1996 | Lindberg | 162/37 |
| 5,639,347 | 6/1997 | Lindberg | 162/65 |

FOREIGN PATENT DOCUMENTS

| | | |
|---|---|---|
| 0 402 335 | 12/1990 | European Pat. Off. . |
| 0512590 | 11/1992 | European Pat. Off. . |
| 8840706 | 6/1988 | WIPO . |
| 9118145 | 11/1991 | WIPO . |
| 9323607 | 11/1993 | WIPO . |
| 9401615 | 1/1994 | WIPO . |

OTHER PUBLICATIONS

Abstract of Japanese Patent Kokai 21590/82—published Feb. 4, 1982.

Bryant P. et al. "Managanese Removal in Closed Kraft Mill Bleach Plants", Tappi Int. Bleaching Conf. Atlanta, Nov. 1–3, 1993, p. 43.

"Partial Closure in Modern Bleaching Sequences", Tappi Int. Bleaching Conf., Washinton, Apr. 14–18, 1996, p. 341.

"Kirk–Othmer Encycl.", the Fourth Edition, vol. 5, p. 779, line 11–15.

*Primary Examiner*—Steven Alvo

*Attorney, Agent, or Firm*—Sughrue, Mion, Zinn, Macpeak & Seas, PLLC

[57] ABSTRACT

A method for the manufacture of non-chlorine bleached pulp, from alkaline digested cellulose pulp, wherein a suspension of the cellulose pulp is subjected to a series to oxygen gas delignification (O), treatment with complexers (Q) and bleaching with non chlorine-containing oxidative bleaching agents (O,P,Z). The various treatment stages interspersed with washing and/or reconcentration of the cellulose pulp in at least one stage, in conjunction with which a suspension liquid is conveyed essentially in strict countercurrent, with the result that the pulp manufacturing process is essentially totally closed with regard to the liquid circuit. The pH value of the suspension liquid, in the absence of a reduction agent, after oxygen gas delignification and onwards into the cellulose pulp treatment chain as far as the bleaching operation with the oxidative bleaching agent, is caused to attain a maximum of 10, and in that the carbonate content of the suspension liquid is caused to be the same as, or to exceed a certain lowest value depending on its position in the cellulose pulp treatment chain.

21 Claims, 1 Drawing Sheet

METHOD FOR NON-CHLORINE BLEACHING OF CELLULOSE PULP WITH A TOTALLY CLOSED COUNTER-CURRENT LIQUID CIRCUIT

TECHNICAL FIELD

The invention relates to a method for the manufacture of bleached cellulose pulp from any previously disclosed lignocellulose material using any previously disclosed alkaline pulping process and essentially environmentally friendly bleaching agents. A large number of lignocellulose materials is available in varying quantities throughout the world. One very common lignocellulose material is wood, which is usually reduced to the form of chips before the digesting or the pulping. The method in accordance with the invention is suitable for both hardwood and softwood. Examples of known alkaline pulping processes are the sulphate process, the polysulphide process, and processes of the soda (sodium hydroxide) process type in which catalyzers, such as some quinone compound, are used. The term sulphate process covers, for example, the use of high sulphidity, the use of counter-current digestion in which white liquor is also added at an advanced stage of the digestion process, and the use of a chemical treatment of the lignocellulose material prior to the actual sulphate digestion.

BACKGROUND ART

In the interests of protecting the environment, the use of bleaching agents such as oxygen (O), one or other per-compound (P) such as hydrogen peroxide and ozone (Z) has recently been suggested for the bleaching of, for instance, sulphate pulp. This has led to the introduction, including on a commercial scale, i.e. full scale, of the use of this type of bleaching agent, including those referred to above, and also in the sequence stated above. By avoiding the use of bleaching agents containing chlorine, which in the final analysis give rise to corrosive chloride, it has proved increasingly possible to close the bleaching plants. The expression closing is used to denote that the washing fluids are handled to an increasing extent within the bleaching plant. In traditional open bleaching plants, the washing fluids (waste liquors) appearing after the respective bleaching stage, including after extraction (E) stage, are allowed to flow directly out to the recipient or, where appropriate, to an external purification plant.

It has emerged from the use of the oxidative bleaching agents exemplified above, and in particular from the use of some per-compound, that the content of metals in the pulp and/or even the presence of metals in general leads to problems. The metals that cause the most problems are the transition metals, of which manganese is the most problematical due to the presence of manganese in such large amounts. Manganese, for example, occurs naturally in the raw material, i.e. in the lignocellulose material, for example in the form of wood. The process water that is used also contains manganese as a general rule, and manganese can also originate from the apparatus used in the pulp manufacturing chain. In an attempt to deal with this problem, a complex forming stage (Q) has been introduced into the pulp treatment chain, preferably directly ahead of the peroxide bleaching stage. The addition of complexers such as EDTA, DTPA and NTA, and others at a suitable pH value, ensures that any free manganese ions are collected and, in particular, the manganese is converted from a fixed form in the pulp to a water soluble complexed form. Manganese complexes of the type $Mn(EDTA)^{2-}$ or $Mn(DTPA)^{3-}$ occur in this case. It is important, after this treatment stage, for the pulp to be washed extremely thoroughly so that no significant quantities of manganese complexes and any free complexers accompany the pulp into the peroxide bleaching stage. The waste liquor generated at this position, i.e. the washing fluid from the complex forming stage, has attracted particular attention of experts and is the subject of more detailed comment below.

A gradually increased closing of the bleaching plant and the pulp manufacturing process in its entirety with regard to the liquid circuit has, as previously indicated, both been proposed and implemented in practice. Different counter-current washing processes for the pulp have been proposed, and it has even been proposed that the washing fluid shall be conveyed in strict counter-current. What is meant by this is that clean washing fluid is introduced into the wash after the final bleaching stage, and that this is conveyed as a counter-current with a constantly increasing degree of contamination through the entire bleaching plant with all its washes and into the unbleached pulp for the purpose of washing that, too, before being conveyed finally, together with the spent digestion liquor making up weak liquor, to the evaporation plant prior to subsequent incineration in the recovery boiler.

In the case of a strictly counter-current liquid circuit through a bleaching plant containing a conventional complex forming stage, it has been assumed (and feared) that the manganese complexes in the solution (washing liquor) are broken down at one or more positions, with the result that the manganese becomes attached to the pulp once more and/or is not removed from the system. It has even been claimed that such a process cannot be avoided. This misgiving has resulted in that hitherto presented proposals for closing the liquid circuit in conjunction with the manufacture of, for example, bleached sulphate pulp include a separate treatment of the washing liquid from the complex forming stage. Examples of proposals include a separate evaporation and destruction of the washing liquid at great expense, and the use of the washing liquid to dissolve the smelt from the recovery boiler.

DISCLOSURE OF THE INVENTION

Technical problem

If the already complexed manganese is set free once more and becomes attached to the pulp in any position, the load on the complex forming stage will be increased to such an extent, in what is an essentially totally closed process, that a considerable quantity of manganese will accompany the pulp into the oxidative bleaching stage following the washing stage, for example the peroxide bleaching stage, with an adverse effect on both the consumption of the bleaching agent and the result of the bleaching process.

The solution

The present invention represents a solution to the aforementioned problem and relates to a method for manufacture of bleached cellulose pulp, in conjunction with which lignocellulose material is digested to form cellulose pulp by means of an alkaline digestion liquor, and the cellulose pulp in the form of a suspension is screened, if necessary, and subjected in series to at least oxygen gas delignification (O), treatment with complexers (Q) and bleaching with non chlorine-containing oxidative bleaching agents (O, P, Z), with the various treatment stages interspersed with washing and/or reconcentration of the cellulose pulp in at least one stage, in conjunction with which the washing liquid (suspension liquid) is conveyed essentially in strict counter-current, with the result that the pulp manufacturing process is essentially totally closed with regard to the liquid circuit, characterized in that the pH value of the suspension liquid, in the absence of a reduction agent, after oxygen gas delignification and onwards into the cellulose pulp treatment chain as far as the bleaching operation with the non chlorine-containing oxidative bleaching agent, is caused to attain a maximum of 10, and in that the carbonate content of the suspension liquid is caused to be the same as, or to exceed a certain lowest value depending on its position in the cellulose pulp treatment chain.

It is preferable for the pH value of the suspension liquid, in the absence of a reduction agent, after oxygen gas delignification and onwards into the cellulose pulp treatment chain as far as the bleaching operation with the non chlorine-containing oxidative bleaching agent, to be caused to attain a maximum of 9.5.

It has been found that the risk of breakdown of the water soluble manganese complexes and subsequent re-adsorption of manganese in the cellulose pulp occurs at those positions in which the oxygen gas delignified cellulose pulp and the suspension liquid are permitted (forced) to be in contact with one another under essentially intact conditions for only a very short time if the pH value exceeds 10 and if the carbonate content is below a specified lowest value.

The oxygen gas delignification of the cellulose pulp can be performed in accordance with any previously disclosed technology, including both medium consistency delignification and high consistency delignification. The appropriate parameters for medium consistency oxygen delignification are: alkali (NaOH) charge=1–50 kg ptm (=per tonne of pulp), giving a pH of 9.5–12; oxygen charge=5–25 kg ptm; temperature=60–120° C.; holding period=20–180 minutes; pressure=0.1–1.0 MPa. The oxygen gas delignification of the cellulose pulp can be performed in one or more consecutive reactor vessels, with or without the charging of additional chemicals.

The treatment of the cellulose pulp with complexers can also be performed in accordance with any previously disclosed technology. The appropriate parameters are: pulp consistency=1–40%, preferably=3–18%; temperature=20–150° C., preferably=50–95° C.; time=1–1000 minutes, preferably=30–300 minutes; complexer (L) charge =0.1–10 kg ptm; pH=4–9.5, preferably=5–7. Magnesium, for example in the form of magnesium sulphate, may be added where appropriate in a quantity of 0.1–10 mmol per litre of liquid, and preferably 0.2–5 mmol per litre of liquid.

In order to achieve sufficiently strong water soluble manganese complexes, it has been found that the complexer=L should have a conditional complexing constant for divalent manganese $Mn^{2+}$ for the reaction $Mn^{2+}+L^{n-}\leftrightarrows MnL^{2-n}$, which exceeds $10^{11}$, at a pH of 12. Two complexers which meet this condition are ethylene dinitrilo tetra-acetic acid (EDTA) and diethylene trinitrilo penta-acetic acid (DTPA). An important feature of the process in accordance with the invention is for the quantity of complexers at the complex forming stage to be a multiple of the quantity of complexers considered to be necessary, by regarding the complex forming stage as an individual stage. The apparent surplus of complexers accompanies the suspension liquid in counter-current, i.e. backwards in the pulp manufacturing chain, and as such serves a useful purpose.

Examples of non chlorine-containing oxidative bleaching agents that can be used at the aforementioned position are oxygen, ozone and one or other per-compound.

Oxygen gas delignification of the cellulose pulp has already been described. As far as bleaching of the cellulose pulp with ozone is concerned, this is performed at a pulp consistency of 8–16% and is otherwise subject to the following parameters: temperature=30–80° C., preferably =45–55° C.; ozone charge=1–10 kg ptm, preferably 3–6 kg ptm; time=0.1–300 seconds, preferably=1–60 seconds; pH=1.5–6, preferably=2.5–3.5.

The preferred bleaching agent at this position is a per-compound, such as for example hydrogen peroxide, sodium peroxide, peracetic acid, peroxosulphate, peroxodisulphate, perborate or organic peroxides.

Of these per-compounds, hydrogen peroxide is preferred absolutely.

Hydrogen peroxide bleaching can be performed both with and without pressurization. The appropriate parameters for bleaching at atmospheric pressure are: time=60–720 minutes, preferably=180–300 minutes; temperature=60–100° C., preferably=75–98° C.; peroxide charge=1–50 kg ptm, preferably=10–40 kg ptm; alkali (NaOH) charge=1–30 kg ptm, preferably 5–25 kg ptm; pulp consistency=3–40%, preferably 8–18%. The alkali charge is adapted so that the pH value in the pulp suspension at the end of the bleaching stage, i.e. the break-pH, lies within the range 10–11.5. A pressure of 0.2–1 MPa, preferably 0.4–0.6 MPa, is used for pressurization. Air and/or oxygen can be used for pressurization. Appropriate parameters in this case are: time=60–180 minutes; temperature=105–120° C.; peroxide charge=5–25 kg ptm; alkali (NaOH) charge=2–20 kg ptm. The pulp consistency and adaptation of the alkali charge are subject to the same parameters indicated above.

As previously indicated, the cellulose pulp must be subjected to at least one washing and/or reconcentration stage before and after the three treatment stages indicated above. Any previously disclosed washing apparatus may be used. Examples of washing apparatuses are washing filters and washing presses. Single-stage and two-stage diffusors can also be used to advantage. Any previously disclosed press can be used for the reconcentration of the cellulose pulp.

In accordance with the invention, it is particularly important for the complex forming stage (Q) and the subsequent washing to be performed in such a way that the quantity of manganese in the form of $MnL^{2-n}$ that accompanies the pulp suspension into the following bleaching stage, preferably the peroxide bleaching stage, attains a maximum value of 10 mg, and preferably 5 mg, per kg of dry pulp.

This quantity of manganese is suitably determined as follows. A sample of the pulp suspension is taken immediately before the bleaching stage. The liquid phase in this pulp suspension is isolated, for example by heavy pressing of the sample. The liquid is filtered through a 0.10 micrometer membrane filter and is analyzed in respect of manganese by atomic absorption spectroscopy. The pulp consistency of the initial sample is determined in a known fashion, and this value and the manganese content of the liquid, determined in accordance with the foregoing, can be taken as the basis for calculating the quantity of manganese in the form of $MnL^{2-n}$, for example $Mn(EDTA)^{2-}$ or $Mn(DTPA)^{3-}$, expressed in milligrams per kilogram of dry pulp.

In order to prevent the breakdown of the water soluble manganese complexes and the subsequent re-adsorption of the manganese in the cellulose pulp, it is important to check and control the carbonate content in the suspension liquid at the treatment stages described above, and in particular in the suspension liquid when it is used in counter-current as a washing (displacement) liquid for the cellulose pulp between the aforementioned treatment stages. The level of the carbonate content in the suspension liquid depends on the position at which the cellulose pulp is situated, as described in detail below.

The expression carbonate content is used to denote the total carbonate per liter of liquid, i.e. the quantity of $CO_3^{2-}$ plus the quantity of $HCO_3^-$ plus the quantity of dissolved $CO_2$.

Surprisingly enough, it has been found to be advantageous if the carbonate content of the suspension liquid during the actual peroxide bleaching stage is equal to or greater than 3 millimol per liter. The fact that the carbonate content of the suspension liquid is also important in the peroxide bleaching stage, which lies after the complex forming stage, would seem to indicate that a certain quantity of manganese that has not been dissolved from the pulp during the complex forming stage nevertheless accompanies the cellulose pulp into the peroxide bleaching stage. The desired carbonate content of the suspension liquid can be achieved through the addition of a carbonate containing compound, or by allowing the suspension liquid to come into contact with the air to such an extent that sufficient carbon dioxide is absorbed from the air and is transferred to carbonate ions. A third method is to add technical grade carbon dioxide.

At the position at which the suspension liquid meets the cellulose pulp in conjunction with the washing process after oxygen gas delignification, the carbonate content should be equal to or greater than 4 millimol/liter, and the carbonate content should preferably exceed 10 millimol/liter.

At the position at which the suspension liquid meets the cellulose pulp immediately ahead of the oxygen gas delignification, the carbonate content should be equal to or greater than 10 millimol/liter, and the carbonate content should preferably exceed 40 millimol/liter.

It is certainly possible to omit screening the unbleached pulp, although it is preferable for the cellulose pulp to be screened directly after the digestion stage. It is also possible to screen the pulp after the oxygen gas delignification.

It has been found to be advantageous if the unbleached cellulose pulp is pressed just before the first washing stage, so as to obtain a pulp consistency in excess of 18%, for example, and so that the liquid removed by pressing, principally spent digestion liquor, is conveyed to a separate container for subsequent splitting into a flow of liquid used for diluting the cellulose pulp that has been digested immediately beforehand, and into a flow of liquid that is mixed with the weak liquor, which then goes for evaporation and incineration.

As previously stated, it is preferable for the cellulose pulp to be treated in the sequence O-Q-P. The sequence O-Q-Z is also entirely possible, however, where appropriate followed by a P stage. In this case, one benefits from treatment with complexers both at the ozone bleaching stage and (in particular) at the peroxide bleaching stage. In the case of hardwood sulphate pulp, bleached in accordance with the foregoing stated, a brightness of 85% ISO is achieved if peroxide is used at the third stage. Fully bleached cellulose pulp, i.e. with a brightness approaching 90% ISO or above, is obtained by adding two further bleaching stages. These bleaching sequences involve the introduction of fresh or clean washing liquid, preferably at the washing stage following the final bleaching stage, after which the washing liquid is preferably conveyed in strict counter-current, so that the spent liquor that results from closing the bleaching plant is combined with the washed out spent digestion liquor to form weak liquor, which assumes the form of thick waste liquor after evaporation and is incinerated in the recovery boiler.

In conjunction with the final bleaching of softwood sulphate pulp, it is appropriate to use the chlorine containing bleaching agent chlorine dioxide (D) in at least one stage, with the aim of producing as strongly bleached sulphate pulp as possible. Since the method for the manufacture of pulp in accordance with the invention is essentially totally closed with regard to the liquid circuit, the use of chlorine dioxide in a relatively small quantity does not pose any environmental problem. It is necessary in this case, however, for a certain amount of chloride to be discharged at an appropriate point in the system, which is described in greater detail later in this specification. Chlorine dioxide has been used as a bleaching agent for a long time, for which reason the associated bleaching conditions are also familiar. The following are typical parameters: charge=10–30 kg ptm; time=15–240 minutes, preferably=30–180 minutes; temperature=40–90° C., preferably=60–80° C.; pulp consistency=1–40%, preferably=3–18%; pH=1.5–4.

The bleaching sequences indicated in this specification are probably very suitable also for cellulose pulps, which have been pulped with an alkaline digestion liquor, other than various types of sulphate pulp.

Advantages

The method in accordance with the invention offers the possibility, with regard to the liquid circuit, essentially to close totally the manufacture of bleached cellulose pulp, including fully bleached cellulose pulp, which has been digested by an alkaline process.

This has previously been presented only as a wish, the satisfaction of which was claimed to lie far ahead in the future, if it were to be possible at all.

Essentially all environmental problems caused by the discharge of liquids are dispensed with in this way, and any residual needs for external cleaning are reduced to a minimum, which also brings down the cost of the pulp manufacturing process in total.

BEST EMBODIMENT

Figure 1:
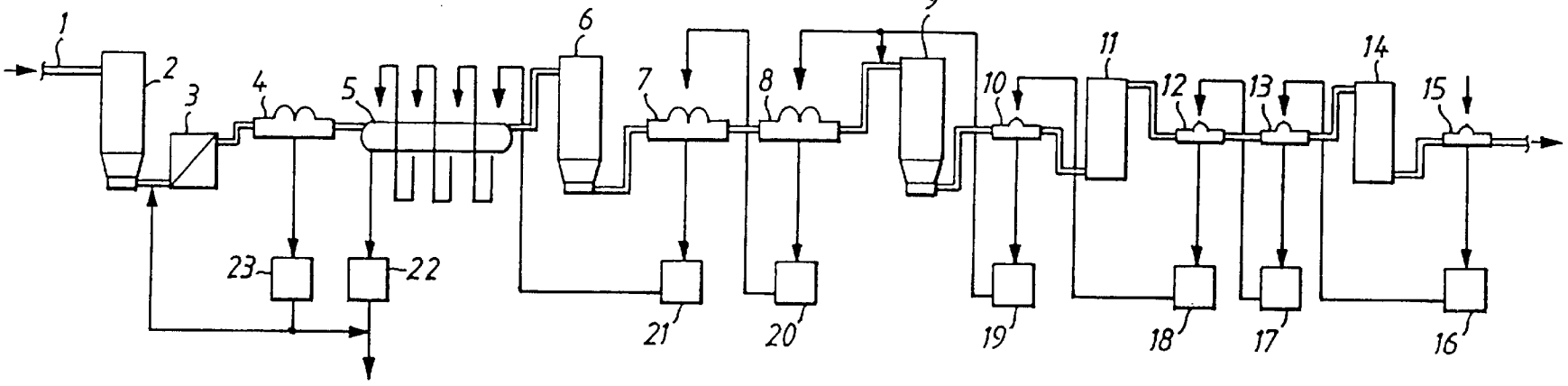
FIG. 1 shows a process diagram for the manufacture of bleached hardwood sulphate pulp in accordance with the invention, where the digestion takes place in batches.

A preferred embodiment of the method in accordance with the invention is described below with reference to FIG. 1. In conjunction with this, a more detailed description is given of certain subsidiary stages in the process, and in addition other embodiments of the invention are described in greater detail. Finally, there follows a number of examples in which certain process parameters are examined.

In the process diagram in accordance with FIG. 1, lignocellulose material in the form of birchwood chips is introduced via the line 1 into the digester 2. Digestion liquor in the form of white liquor, where appropriate mixed with spent digestion liquor or black liquor, is also introduced into the digester. On completion of the sulphate digestion process, the charge is blown so that cellulose pulp with a certain pulp consistency results. The newly manufactured cellulose pulp contains a certain amount of lignin. The lignin content, measured as a kappa number, ususally lies within the range 12–18 for conventional digestion, and 8–15 for modified digestion. The pulp suspension in question is screened in the screening unit 3, and the pulp that is accepted is conveyed to a press 4 where the pulp consistensy is increased so that it exceeds 18%, for example. Lignocellulose material separated in the screening unit 3, referred to as reject, can be returned to the digester 2 and/or conveyed to a plant for producing knot pulp.

After dilution with suspension liquid, the unbleached cellulose pulp is introduced onto a belt washer 5, where most of the spent digestion liquor remaining in the cellulose pulp is removed. The cellulose pulp is then introduced into an oxygen gas delignification (bleaching) reactor 6, where the cellulose pulp is treated with oxygen gas at increased pressure and under alkaline conditions in the manner described previously. The lignin content of the cellulose pulp is reduced as a result of this treatment, and usually lies, measured as a kappa number, within the range 5–11. The alkaline cellulose pulp is then taken to a first washing press 7, and thereafter to a second washing press 8. After these washing operations, the cellulose pulp is conveyed to a storage tower 9, where the cellulose pulp can be kept for a period of, for example, 4–8 hours. There is usually one such storage tower in most sulphate mills, and the reason for it is essentially to create a buffer of cellulose pulp. This arrangement means that one is well prepared for problems arising in the preceding and following treatment stages, including bleaching stages. The average time spent in the storage tower 9 can naturally vary from mill to mill. The cellulose pulp is conveyed from this tower to a washing filter 10, after which the cellulose pulp is introduced into a tower 11, where it is treated with complexers in a previously described fashion. In accordance with the present method, it is of particular importance to select a complexer of a kind that produces a very strong manganese complex under alkaline conditions in accordance with what has been stated previously. After treatment with the complexer, it is important for the cellulose pulp to be washed very thorougly, given that the intention at this position is to remove the largest possible quantity of transition metals, and in particular manganese, from the cellulose pulp suspension. The maximum quantity of manganese in the form of $Mn(EDTA)^{2-}$ that is allowed to accompany the pulp suspension into the peroxide bleaching stage is 10 mg per kg of dry pulp, in accordance with the foregoing. In this case, the cellulose pulp is conveyed to a first washing filter 12 and a second washing filter 13, and thereafter to the bleaching tower 14, where the cellulose pulp is bleached with hydrogen peroxide in a previously described fashion. Once the cellulose pulp leaves the bleaching tower 14, it may have a kappa number of 2–6 and a brightness, as previously mentioned, of approximately 85% ISO. The cellulose pulp is finally conveyed to a washing filter 15. A pulp of this kind may, for example, either be dried to produce market pulp, or be transported at a low pulp consistency to a nearby paper mill. Before then, the cellulose pulp may be further purified, if required, by means of an end screening, which is sometimes referred to as fine screening or final screening.

Until now, attention has been directed essentially at the path of the lignocellulose material, including the cellulose pulp, through the pulp manufacturing process. There now follows a description of the path of the washing (suspension) liquid in the pulp manufacturing process, which is the direct opposite of the path of the cellulose pulp. In conjunction with this, the critical parameters for the invention will be commented upon in greater detail. It may be mentioned, by way of explanation, that the path of the cellulose pulp is shown as a heavy line (pipes) in FIG. 1, whereas the path of the suspension liquid is shown as a lighter line. Clean washing (suspension) liquid, preferably in the form of clean water, is applied to the cellulose pulp on the washing filter 15, The quantity of washing liquor added is equivalent, for example, to a dilution factor of 0 to 2. The washing liquid is collected in the storage tank 16 after washing the cellulose pulp. A proportion of the washing liquid is then conveyed in counter-current to the washing filter 13. All the storage tanks for washing liquid have a relatively large volume, since the majority of the washing liquid at each washing stage is used internally in the washing stage for diluting the cellulose pulp before it is taken up on the washing filter (i.e. the wire cloth) concerned. A proportion of the washing liquid is also used for diluting the cellulose pulp when it leaves the wire cloth as a continuous web. The quantity of washing liquid required at this position is determined to some extent by the pulp consistency that one wishes to use in the following treatment stage for the cellulose pulp, for example a complex forming stage or a bleaching stage. The washing liquid in the storage tank 16 can be strongly alkaline, depending on what pH was used in the peroxide bleaching stage 14. If the pH value of the washing liquid is greater than 10, some form of acid must be added, for example to the storage tank 16 or to the washing liquid just after it leaves the storage tank 16, so as to bring down the pH value to 10 or below, and preferably to below 9.5. Examples of suitable acidification agents are given later in the text.

The washing liquid recovered in the washing filter 13 is collected in the storage tank 17, and a proportion of that washing liquid is sprayed onto the pulp web in the washing filter 12, to be collected once more in the storage tank 18. A proportion of the washing liquid present in the storage tank 18 is conveyed to the washing filter 10, where it is sprayed onto the cellulose pulp. The washing liquid recovered here is collected in the storage tank 19. A proportion of this washing liquid is conveyed onwards in counter-current, and is used on the one hand for diluting the cellulose pulp as it is introduced into the storage tower 9, which indicates that storage of the cellulose pulp takes place at a low pulp consistency, and on the other hand for contacting the cellulose pulp in the washing press 8. The washing liquid removed by pressing here is collected in the storage tank 20.

A proportion of this washing liquid is added to the cellulose pulp in the washing press 7. Again, the washing liquid removed by pressing here is collected in storage tank 21. A proportion of this washing liquid is added to the cellulose pulp in strict counter-current on the belt washer 5, to be collected in the form of weak liquor in storage tank 22. From having been clean water in position 15, for example, the content of both organic and inorganic compounds or substances in the washing liquid has increased in the direction of the counter-current, and the weak liquor finally obtained consists of a mixture of spent digestion liquor and various substances dissolved and washed out from the various treatment stages in the bleaching plant which is closed with regard to its liquid circuit. The resulting weak liquor is conveyed from storage tank 22 to an evaporation unit, after which the liquor in the form of thick waste liquor is incinerated in the recovery boiler.

According to this embodiment of the invention, a large proportion of the spent digestion liquor is removed from the cellulose pulp by pressing in the press 4 before the cellulose pulp comes into contact with the washing liquid on the belt washer 5. The spent digestion liquor removed by pressing is split and conveyed, on the one hand, to the freshly digested cellulose pulp for the purpose of diluting it prior to screening and, on the other hand, to the weak liquor, with which it is mixed, and which is then transported away for evaporation. This flow of spent digestion liquor accordingly does not come into contact with the washing liquid until after both liquids have been separated from the cellulose pulp. The reason for this will be given later in the text.

As previously mentioned, the critical factor in this context and, if you wish, the core of the invention, is to keep intact the water soluble complexes of transition metals, predominantly manganese, which were finally formed at the complexing stage 11, as the washing liquid or suspension liquid is conveyed against the cellulose pulp in stage after stage and is finally collected in storage tank 22. The weak liquor is then conveyed for evaporation, after which it is incinerated in the form of thick waste liquor. If one is first successful in complexing most of the manganese present in the system, including that which is fixed to the cellulose pulp, in so doing removing the manganese from it, and if one is then successful in maintaining the complexes in solution in the liquid phase until achieving the aforementioned final objective, the manganese will be rendered harmless, i.e. its strongly negative (destructive) effect on oxidative bleaches, such as hydrogen peroxide, is prevented, and in the final analysis the complexer is destroyed in the recovery boiler and leaves it together with the flue gases in the form of the harmless chemicals carbon dioxide, water vapour and nitrogen gas, whereas the manganese is first trapped in the smelt and then in the green liquor sludge and is removed in that form from the pulp manufacturing process.

In order to succeed with the above, the treatment of the cellulose pulp after oxygen gas delignification at position 6 and as far as hydrogen peroxide bleaching at position 14 is particularly important.

A too high pH during contact between the cellulose pulp and the suspension liquid and a too low carbonate content in the system will lead to destruction of the water soluble manganese complexes.

If these complexes are destroyed, the manganese in the form of ions can be re-adsorbed by the cellulose pulp, and/or the manganese will be precipitated out in solid form, for example as an oxide or hydroxide, and will accompany (and possibly become attached to) the cellulose pulp as far as and into the oxidative bleaching stage, for example the hydrogen peroxide stage at position 14.

Contact between the cellulose pulp and the suspension liquid occurs to the greatest degree in the storage tower 9, where the holding period may be 4–8 hours. At that position, it is essential to ensure that the pH value of the pulp suspension/suspension liquid is as highest 10, and is preferably below 9.5, and that the carbonate content of the suspension liquid is sufficiently high, for example greater than 10 mmol/liter. The restriction of the pH to this maximum value applies on condition that essentially no reduction agents, for example of the type $HS^-$ or $BH_4^-$, are present. The total absence of these reduction agents from the pulp suspension is normally the case, since the pulp suspension has already been subjected to powerful oxygen gas treatment resulting in the destruction of any reduction agents present in the form of $HS^-$. Once the pulp suspension, for example, has left the oxygen gas delignification reactor 6 and has been conveyed to the washing press 7, it has a pH value well in excess of 10 as a general rule, especially if a lot of alkali was used at stage 6, in addition to which the liquid accompanying the pulp is saturated with regard to dissolved gas.

If the pH value in the pulp suspension at this position is well in excess of 10, it should be brought down to a value of 10 or less. This is most appropriately achieved by acidifying the suspension liquid in storage tank 21 or that part of the suspension liquid that is intercirculated from the tank up to the inlet section of the washing press 7. This can be done with sulphuric acid or some other mineral acid. The addition of carbon dioxide in gaseous form is to be preferred. The addition of carbon dioxide contributes, on the one hand, to lowering the pH value to the desired level and, on the other hand, to increasing the carbonate content in the suspension liquid, which is also positive. The pH value must not be lowered severely at this position, bearing in mind the risk of lignin reprecipitation, and cautious lowering of the pH value is to be preferred.

At this position, unlike the other affected positions, a pH slightly higher than 10 can be tolerated in the pulp suspension, although it is not recommended. A pH slightly higher than 10 leads to limited reprecipitation of manganese on the pulp, although it is possible to compensate for this at the following positions 9 and 11.

The critical pH value at position 9 can be increased if a reduction agent is added to the pulp suspension when washing the pulp before or during introduction of the pulp suspension into the storage tower 9. Examples of reduction agents whose use is conceivable are hydrogen sulphide anion ($HS^-$), sulphite ($SO_3^{2-}$) and boron hydride ($BH_4^-$). The use of these chemicals is associated with disadvantages, however. As far as hydrogen sulphide anion is concerned, the chemical naturally commands a certain price, in addition to which the risk is present of the formation of hydrogen sulphide, a toxic gas, for example when the cellulose pulp at position 10 is brought into contact with the naturally acidic or neutral suspension liquid originating from the storage tank 18. The main disadvantage of boron hydride is its high price. Furthermore, a further element, i.e. boron, is introduced, and this must be removed from the chemical recovery system and then via the green liquor sludge. The expression reduction agent does not include the organic reduction agents naturally occurring and/or formed in the process, such as the various forms of sugar.

Further back in the flow chart, for example on the belt washer 5, the pulp suspension is strongly alkaline, for example with a pH greater than 11. This high pH or, to put it another way, this high concentration of $OH^-$ ions, should, in the conclusion reached and the belief held by many experts, lead to the total destruction of the water soluble manganese complexes. This is not the case, however, if one takes steps to ensure that the carbonate content in the suspension liquid at this position is sufficiently high, i.e. is identical with or greater than 10 millimol/liter and preferably exceeds 40 millimol/liter. Such high carbonate contents in the suspension liquid can be achieved by the addition of gaseous carbon dioxide in large quantities to the suspension liquid and/or the pulp suspension. The addition of carbon dioxide at this position has been suggested for entirely different reasons, and as such is a positive feature of the method in accordance with the invention.

A contributory reason for the manganese complexes at this position not being destroyed is that the pulp suspension, as a residue from the digestion stage, contains a considerable quantity of reduction agent ($HS^-$). The pH is also very high during the oxygen gas delignification of the cellulose pulp, i.e. at position 6, in addition to which the reduction agent ($HS^-$) is destroyed by the oxygen gas. Because of the special conditions that apply at this stage, which in themselves may be considered dangerous, the manganese is retained in a divalent form, which is a condition for the complexer, for example EDTA and/or DTPA, to be capable of transferring manganese from the cellulose pulp to the liquid phase at a pH greater than 7. If manganese has been formed with oxidation number III or IV, pH 5 or lower is required in order to dissolve these forms of oxide with EDTA.

A high concentration of $OH^-$ ions in the pulp suspension is rather negative, as already stated. One way of significantly reducing the concentration of hydroxide ions in the pulp suspension at an early stage of pulp manufacture is, as shown in FIG. 1 and described above, to incorporate a press 4 (or several presses) between the screening unit 3 and the belt washer 5. A large quantity of spent digestion liquor, which is known to be extremely rich in hydroxide ions, is removed in this way from the cellulose pulp, as well as from the closed washing liquid system.

It must be emphasized, however, that the installation of such a press is not a condition for the method in accordance with the invention to function.

Although it is highly advantageous in practice from the point of view of pulp manufacture (operating reliability) to make use of a storage tower/buffer vessel 9, it is still possible to exclude this. In this case, the oxygen gas delignified and washed cellulose pulp is transferred directly to the complex forming stage 11. With regard to this treatment stage, the requirement for the pH not to be too high is already met by the fact that the removal of the largest possible quantity of manganese from the pulp for the purpose of forming a water soluble manganese complex is favoured by a neutral or weakly acidic environment. This relatively low pH level in the pulp suspension is ususally obtained by the addition of a strong acid, such as sulphuric acid. In order to be able to regulate the pH value at certain positions in accordance with the invention, use is made of the pH values prevailing in the suspension liquid, adapted to the various treatment stages as such, and if this is not sufficient, use is made of the aforementioned acids, i.e. carbonic acid (carbon dioxide) and sulphuric acid.

FIG. 1 illustrates only the short bleaching sequence O-Q-P leading to a final pulp brightness of approximately 85% ISO. As previously indicated, there is nothing to prevent the bleaching sequence from being extended by one or more bleaching stages. These bleaching stages are also followed by at least one washing stage, and in conjunction with the application of the invention in these contexts, fresh washing liquid is added, for example clean water, to the last washing apparatus in the line, after which the suspension liquid is conveyed in strict counter-current through the entire pulp manufacturing chain.

An essential closing of the liquid circuit through the entire pulp manufacturing chain in accordance with what is described and illustrated above can lead to certain other problems.

If, for example, the resin content in the suspension liquid at any position becomes too high, with the result that resin deposition problems occur at some point in the system, and/or that the resin content of the cellulose pulp is too high, technology is already availabel to solve that problem.

An example of such technology is that described in Swedish Patent Specification 8705141-3 (459 925). An appropriate position for the discharge of resin from the system is provided by treating the suspension liquid (or part of it) in accordance with the patented method as it is on its way to be collected in the storage tank 21.

Since the complexed transition metals, mainly manganese, finally end up in the green liquor sludge, it is necessary, in order to remove the manganese essentially in its entirety from the system, for the green liquor clarification process to function in an optimal fashion. Two suitable methods in this context are those described in Swedish Patent Applications 9203634-2 and 9301598-0.

FIG. 1 shows certain washing apparatuses between the various treatment stages. The method in accordance with the invention is naturally not associated with a certain type of washing apparatus, or with a certain number of washing apparatuses, between the treatment stages. Examples of types of washing apparatuses other than those shown in FIG. 1 are singel-stage and two-stage diffusers, whether or not pressurized, both of which may be used with advantage.

Position 1 in FIG. 1 shows a batch digester. In actual fact, a number of batch digesters is always used. A continuous digester may be used, of course, in place of batch digesters. A digester of this kind may occasionally consist of a small preimpregnation vessel followed by the digester itself. This type of digester has such a large capacity that it is often sufficient to use only a singel digester, although two may be used.

In those cases in which the lower part of the continuous digester is used for washing the cellulose pulp, the so-called Hi-Heat Wash, the washing liquid circuit differs somewhat from that shown in FIG. 1. It is then not possible, for example, to press only spent digestion liquor from the cellulose pulp at position 4, since the cellulose pulp in this case and at this position contains spent digestion liquor residues and, in particular, spent liquor from the bleaching process. Instead of the relatively concentrated washing liquid being collected in the storage tank 22 in accordance with FIG. 1, the spent liquor from the bleaching plant is conveyed into the digester, where it meets the cellulose pulp mixed with spent digestion liquor in counter-current, after which a large proportion of the spent digestion liquor and the spent liquor from the bleaching process mixed together in the form of weak liquor leave the digester and are conveyed to the evaporation unit, after which the liquor in the form of thick waste liquor is incinerated in the recovery boiler.

It is preferable to apply the invention to the manufacture of fully bleached cellulose pulp, i.e. with a brightness approaching 90% ISO and even higher. One advantage of removing the lignin almost in its entirety from the cellulose pulp is that this imparts brightness stability to the pulp.

A very large number of bleaching sequences can be used. Listed below are some of the preferred ones, which can be used for both hardwood and softwood pulp:

O-Q-P-Z-P

O-Q-P-Z-Q-P

O-Q-P-Z-D-(P)

O-Q-P-D-P

O-Q-P-D-D

Peroxide (P) in the third stage can, as previously indicated, be replaced by oxygen gas. Peroxide (P) and oxygen gas (O) can be used as a mixture in the third stage.

Ozone can be used in place of peroxide in the third treatment stage, as previously mentioned. The medium pulp consistency is used at the ozone stage in this case. A number of further bleaching sequences now follows, which can be used for both hardwood and softwood pulp:

O-Q-Z-P

O-Q-Z-Q-P

O-Q-Z-D-(P)

When using chlorine dioxide as a bleaching agent, a certain amount of chloride is formed and is present in the liquid system, since this is essentially totally closed. The quantity of chloride formed must be discharged from the chemical recovery system, for which several previously disclosed methods are available. One way involves removing chlorides in the form of hydrochloric acid by scrubbing the flue gases from the recovery boiler. Another way involves removing a certain quantity of electrostatic precipitator dust which is enriched with chloride. The electrostatic precipitator dust can also be obtained from the flue gases that occur when the thick waste liquor is incinerated in the recovery boiler.

The closing of the liquid circuit throughout the entire pulp manufacturing chain described here also means that chemicals used in the bleaching process, for example sodium hydroxide and sulphuric acid, are recovered, and that compounds of sodium and sulphur are consequently enriched in the chemical recovery system. This problem can be overcome in various ways. One alternative is to generate sodium hydroxide and sulphuric acid internally from sodium sulphate in accordance with Swedish Patent Application 9102693-0. Another alternative is to remove a certain amount of sodium sulphate in the form of electrostatic precipitator dust or in some other form from the liquor system. Combinations of these methods may be advantageous, for example, for balancing the sodium, sulphur and chloride compounds present in the liquor system.

The brightness values and kappa numbers for the cellulose pulp referred to in this specification relate to the measurement methods SCAN-C11:75 and SCAN-C1:77 respectively.

EXAMPLE 1

Below tests are given conducted in a birch sulphate pulp mill with a flow chart resembling that shown in FIG. 1. The only difference was that the mill lacked the press 4 with its connecting lines.

The cellulose pulp was oxygen gas delignified (O) at position 6. The cellulose pulp was kept for about 6 hours at position 9. Complexers (Q) were added to the cellulose pulp at position 11, and the cellulose pulp was finally bleached with hydrogen peroxide (P) at position 14.

The total manganese content in the cellulose pulp was measured at three positions, on the one hand when pulp manufacture was performed in accordance with the invention, including conveying the washing liquid in strict counter-current from the washing filter 15 after the peroxide bleaching stage 14 to the storage tank 22 below the belt washer 5 and, on the other hand, when pulp manufacture was performed in accordance with what was said to be the process preferred by others, i.e. the washing liquid was conveyed in counter-current from position 15 to the washing filter 10 after the storage/buffer tower 9. The liquid from the aforementioned washing filter was discharged into a drain.

The parameters for the aforementioned treatment and bleaching stages were identical in both cases and lay within the previously described framework. As far as the complexing stage is concerned, EDTA was used, and this complexer was added in a quantity equivalent to five times the total quantity of the element manganese present at this stage. This meant that a certain quantity of the available complexer was conveyed within the system in counter-current, and as far as the tests in accordance with the invention are concerned, this continues to be the case as far as the recovery boiler, where the complexer is destroyed. In the test conducted in accordance with the invention, the pH and the carbonate content of the suspension (washing) liquid were controlled at the various positions so that these two parameters were in agreement with what had already been stated. In the comparative test, the same pH values and carbonate contents were used in the washing liquid in the corresponding part of the liquid circuit, i.e. from position 15 to position 10. This washing liquid was conveyed to a drain after this point, as already mentioned. New washing liquid was added at position 8, and used for dilution at position 9, and was conveyed backwards in the system in order to end up as weak liquor, which was then evaporated and incinerated in the recovery boiler.

Samples of the pulp suspension were taken in both cases as the pulp suspension was on its way into the oxygen gas delignification reactor, i.e. position 6, when the pulp suspension was on its way into the complex forming stage, i.e. position 11, and when the pulp suspension was on its way into the hydrogen peroxide bleaching stage, i.e. position 14. The pulp concentration was 15% in all cases. The samples were oven-dried and turned to ash, and the ash was then dissolved in hydrochloric acid. The resulting solution was analyzed in respect of manganese by atomic absorption spectroscopy. This method of analysis means that both manganese that is fixed to the pulp and manganese in the liquid phase in the form of the dissolved complex $Mn(EDTA)^{2-}$ are included in the test result.

The test results thus reflect the total manganese content in mg Mn/kg of dry pulp, and can be appreciated from Table 1 below.

TABLE 1

| | Pos. 6 | Pos. 11 | Pos. 14 |
|---|---|---|---|
| According to the invention | 130 | 106 | 6 |
| According to previously recommended technology | 130 | 150 | 6 |

Surprisingly enough, it has been found that, in the case of the test in accordance with the invention, the manganese content obtained, i.e. 106 mg Mn/kg dry pulp, is lower in comparison with the test in accordance with previously disclosed technology, with a manganese content of 150 mg Mn/kg dry pulp, in position 11, i.e. when the pulp suspension was on its way into the complex forming stage. This means that the load on this stage is reduced in the method in accordance with the invention by comparison with previously disclosed technology.

Because the manganese content at position 6 was the same in both cases, something positive must have occurred between position 6 and position 10 in the test in accordance with the invention. The fact that the pulp is kept for a long period in the buffer tower 9 presumably has a positive effect. Because the complexer, EDTA, was added with a large surplus, a certain quantity of available complexer was present in the washing (suspension) liquid that was introduced into the storage tower 9 together with the cellulose pulp, and the complexer was offered the opportunity, whilst in this tower, to dissolve manganese from the cellulose pulp and to form the liquid soluble complex $Mn(EDTA)^{2-}$. This then accompanied the pulp suspension to the washing filter 10, at which position it was removed to a certain extent from the pulp suspension as it continued on its way.

EXAMPLE 2

In the same birch sulphate pulp line described in Example 1, cellulose pulp was taken from the washing press 8. In addition, suspension liquid was taken from the storage tank 19. As previously explained, this suspension liquid contains a large surplus of the complexer, which was EDTA in this case, too.

The sampled material was transported to the laboratory, where the following tests were performed.

The cellulose pulp and the supension liquid were mixed together to produce a pulp suspension with a consistency of 7%. The carbonate content of the suspension liquid was kept at a constant level of 4 millimol/liter. Sulphuric acid or sodium hydroxide were added to the pulp suspension in order to vary the pH value in different samples in accordance with the details given below. After the pH value in the pulp suspension had been adjusted, the various samples were stored in containers immersed in a water bath at a temperature of 70° C. for a period of 3 hours. The samples were then allowed to cool to room temperature, after which the pH value of the pulp suspension was measured. The samples were then washed thoroughly with distilled water, after which the total manganese content of the pulp was determined by the method described above.

A proportion of the starting pulp was washed in the same way as the samples, and its manganese content was determined in the same way as previously described, and it emerged that the manganese content of the pulp was 73 mg per kg of dry pulp.

The pH value and the manganese content of the various pulp samples are shown in Table 2 below.

TABLE 2

| pH | Manganese content in mg per kg of dry pulp |
|---|---|
| 8.2 | 38 |
| 8.4 | 40 |
| 8.6 | 58 |
| 9.3 | 68 |
| 10.3 | 79 |
| 11.2 | 91 |

Since the manganese content of the starting pulp was 73 mg, the above series of tests shows that, where pH values greater than 10 are used in the pulp suspension, re-adsorption of manganese from the liquid phase to the pulp occurs. At pH values of 10.3 and 11.2, the manganese content can be seen to be 79 mg and 91 mg respectively. The levels of the $Mn(EDTA)^{2-}$ complex in the liquid phase were found in the tests to be such that, in the event of all the manganese being re-adsorbed onto the pulp, the manganese content of the pulp would have been 131 mg/kg.

At a pH value of 9.3, the manganese content of the pulp, at 68 mg, must be compared with the 73 mg of the starting pulp. In this case, manganese has been dissolved from the pulp and has found its way into the liquid phase in the form of the complex $Mn(EDTA)^{2-}$. This effect becomes all the more pronounced as the pH value of the pulp suspension falls.

These results show that the pH value of the suspension liquid at position 7, i.e. immediately after position 6, should not exceed 10, and that a pH value of 9.5 or lower is preferable. Due in part to the risk of lignin precipitation at this position, a certain level of re-adsorption of manganese from the liquid phase to the pulp is acceptable, which takes place at pH values greater than 10. This occasional smaller increase in the manganese content must, in this event, be compensated for subsequently in the treatment chain, for instance at position 9 or position 11.

A number of tests similar to those described above, in which the carbonate content of the suspension liquid was increased to 10 millimol per liter or higher by the addition of sodium carbonate solution, indicate that the manganese content of the pulp in the pH range 8–10 is lower than those indicated in Table 2 by approximately 10 mg per kg of dry pulp.

EXAMPLE 3

In the same birch sulphate pulp line described in Example 1, cellulose pulp was taken from washing filter 10.

The cellulose pulp was transported to the laboratory, where the following tests were performed.

The cellulose pulp was treated with the EDTA complexer at a pH just above 6, and the conventional routine was otherwise followed. The cellulose pulp was then washed thoroughly with distilled water. The cellulose pulp was mixed with clean water to produce a pulp consistency of 10%. Sodium carbonate was added to the pulp suspension in increasing quantities, apart from to one sample.

The pulp samples were then bleached with hydrogen peroxide under the following conditions.

Temperature=90° C. Time=180 minutes. Charge $H_2O_2$=2.5%, calculated in relation to the dry weight of the pulp; and charge NaOH=1.4%, calculated in relation to the dry weight of the pulp.

The result of bleaching can be presented in various ways, and here we have opted to indicate the quantity of remaining hydrogen peroxide after bleaching as a percentage by weight, calculated in relation to the dry weight of the pulp.

The results achieved can be appreciated from Table 3 below.

TABLE 3

| Carbonate content in the suspension liquid millimol/liter | Residual peroxide, % |
|---|---|
| 0 | 0.19 |
| 1 | 0.34 |
| 3 | 0.74 |
| 10 | 0.87 |

As can be seen, the quantity of unused hydrogen peroxide increases noticeably at a carbonate content of 3 millimol per liter in comparison with carbonate contents of 0 and 1 millimol per liter respectively. No less than 0.74% of hydrogen peroxide remains, which may be compared with the charge quantity of 2.5%. A threefold increase in the carbonate content causes the residual quantity of peroxide to increase to 0.87%.

The pH value used in the complex forming stage in the manufacture of bleached cellulose pulp on a large scale is, to some degree, the determining factor for the carbonate content of the suspension liquid. If very low pH values are used at this stage, a large part of the carbonate present in the suspension liquid is transformed into gaseous carbon dioxide and leaves the suspension liquid behind. Under mill conditions, carbonate contents significantly below 0.5 millimol per liter have been recorded in the suspension liquid immediately after the pulp suspension left the complex forming stage, i.e. between position 11 and position 12. Since a particular carbonate content in the suspension liquid, in accordance with what is illustrated above, has a clearly positive effect on the hydrogen peroxide bleaching process, carbonate must be added to the pulp suspension in such cases before it is introduced into the hydrogen peroxide stage, i.e. position 14. It is emphasized that the added carbonate must be very pure in order to prevent any impurities from causing the hydrogen peroxide to break down. In a large scale operation, i.e. a pulp mill, it is advantageous if the source of carbonate consists of air or pure carbon dioxide.

We claim:

1. Method for producing bleached cellulose pulp comprising:

digesting, by means of an alkaline digestion liquor, a transition metal containing lignocellulose material to form cellulose pulp;

subjecting the cellulose pulp in the form of a suspension to a cellulose pulp treatment chain comprising the following stages:

1) treatment stages including;

an oxygen gas delignification stage (O), a complexing stage (Q) involving treatment with complexers to form a water soluble transition metal complex, and a bleaching stage involving bleaching with a non chlorine-containing oxidative bleaching agent;

2) at least one stage of washing and/or reconcentrating interspersed between said treatment stages in said cellulose pulp treatment chain;

conveying a suspension liquid essentially in strict counter-current to pulp flow into a thick waste liquor, which is combusted;

wherein the pH value of the suspension liquid is maintained at ≦10, in the absence of a reducing agent, from just after oxygen gas delignification and onwards with respect to direction of pulp flow into the cellulose pulp treatment chain as far as the bleaching stage with the non chlorine-containing oxidative bleaching agent, and wherein the carbonate content of the suspension liquid is maintained at or in excess over a minimum value for each stage of the chain, said minimum value determined by the stage in the cellulose pulp treatment chain, said pH value in the stages concerned and said minimum value of carbonate content, at each stage of the process where complexer is present, being sufficient to keep the formed water soluble transition metal complexes intact in the suspension liquid as said suspension liquid flows backwards with respect to direction of pulp flow in the whole cellulose pulp treatment chain, with the water-soluble transition metal complex intact up to and through a washing stage that occurs in the direction of pulp flow before the oxygen gas delignification stage;

with the result that the pulp manufacturing process is essentially totally closed with regard to the liquid circuit.

2. Method in accordance with claim 1, wherein the pH value of the suspension liquid, in the absence of a reduction agent, after oxygen gas delignification and onwards into the cellulose pulp treatment chain as far as the bleaching operation with the non chlorine-containing oxidative bleaching agent, is maintained at value ≦9.5.

3. Method in accordance with claims 1, wherein the carbonate content of the suspension liquid, which meets the cellulose pulp in conjunction with the pulp washing process after oxygen gas delignification, is equal to or greater than 4 millimol/liter.

4. Method in accordance with claim 1 wherein the carbonate content of the suspension liquid, which meets the cellulose pulp in conjunction with the pulp washing process stage immediately before the oxygen gas delignification stage is equal to or greater than 10 millimol/liter.

5. The method according to claim 4, wherein said carbonate content exceeds 40 millimol/liter.

6. Method in accordance with claim 1, wherein the non chlorine-containing oxidative bleaching agent consists of a per-compound.

7. Method in accordance with claim 6, wherein the carbonate content of the suspension liquid during the peroxide bleaching stage is equal to or greater than 3 millimol per liter.

8. Method in accordance with claim 1, wherein the complexer (L) has a conditional complexing constant for divalent manganese $Mn^{2+}$ for the reaction $Mn^{2+}+L^{n-} \rightleftharpoons MnL^{2-n}$, which exceeds $10^{11}$, at a pH of 12.

9. Method in accordance with claim 8, wherein the complexer (L) is ethylene dinitrilo tetra-acetic acid (EDTA) and/or diethylene trinitrilo penta-acetic acid (DTPA).

10. Method in accordance with claim 1, wherein the complexing stage (Q) uses a complexer L and the subsequent washing are executed in such a way that the quantity of manganese in the form of $MnL^{2-n}$ that accompanies the pulp into the following bleaching stage, attains a value not to exceed 10 mg per kg of dry pulp.

11. The method according to claim 10, wherein said quantity of manganese obtains a value not to exceed 5 mg per kg of dry pulp.

12. Method in accordance with claim 1, wherein the cellulose pulp before bleaching is pressed Just before the washing, so as to obtain a pulp consistency in excess of 18%, and in that the liquid removed by pressing, mainly spent digestion liquor, is conveyed to a separate container for subsequent splitting into a flow of liquid used for diluting the cellulose pulp that has been digested immediately beforehand, and into a flow of liquid that is mixed with the weak liquor, which is then returned for evaporation and incineration.

13. Method in accordance with claim 1, wherein fully bleached cellulose pulp is manufactured using ozone (Z) followed by peroxide (P) as the final bleaching stages.

14. Method in accordance with claim 1, wherein fully bleached cellulose pulp is manufactured using ozone (Z) followed by a complexing stage (Q) and by peroxide (P) as the final treatment stages.

15. Method in accordance with claim 1, wherein fully bleached cellulose pulp is manufactured using ozone (Z) followed by chlorine dioxide (D) as the final bleaching stages.

16. The method in accordance with claim 15, further using peroxide (P) after chlorine dioxide (D).

17. Method in accordance with claim 1, wherein fully bleached cellulose pulp is manufactured using chlorine dioxide (D) followed by peroxide (P) as the final bleaching stages.

18. Method in accordance with claim 1, wherein fully bleached cellulose pulp is manufactured using two chlorine dioxide (D) stages in series, as the final bleaching stages.

19. The method according to claim 1, wherein the cellulose pulp in the form of a suspension is screened after said material is digested.

20. The method in accordance with claim 1, wherein the cellulose pulp in the form of a suspension is screened after said oxygen gas delignification stage.

21. The method according to claim 1, wherein said suspension liquid is conveyed essentially in strict counter-current from the washing filter (15) to a storage tank (22).

* * * * *